United States Patent [19]

Lamont et al.

[11] Patent Number: 4,775,343

[45] **Date of Patent: * Oct. 4, 1988**

[54] HYDRODYNAMIC SWIM FIN

[75] Inventors: Mark D. Lamont, Long Beach; Peter A. Chopelas, Lakewood, both of Calif.

[73] Assignee: Undersea Industries, Inc., Rancho Dominguez, Calif.

[ * ] Notice: The portion of the term of this patent subsequent to Apr. 12, 2005 has been disclaimed.

[21] Appl. No.: 796,976

[22] Filed: Nov. 12, 1985 (Under 37 CFR 1.47)

[51] Int. Cl.[4] ..... A63B 31/10

[52] U.S. Cl. ..... 441/64

[58] Field of Search ..... 441/55, 62–64; D21/239

[56] References Cited

U.S. PATENT DOCUMENTS

| | | | |
|---|---|---|---|
| Re. 23,006 | 6/1948 | Churchill | 441/64 |
| 2,737,668 | 3/1956 | Cressi et al. | 441/64 |
| 3,082,442 | 3/1963 | Cousteau et al. | 441/64 |
| 3,183,529 | 5/1965 | Beuchat | 441/64 |
| 3,810,269 | 5/1974 | Tabata et al. | 441/64 |

FOREIGN PATENT DOCUMENTS

| | | | |
|---|---|---|---|
| 2355529 | 1/1978 | France | 441/64 |
| 351204 | 2/1961 | Switzerland | 441/64 |

OTHER PUBLICATIONS

Skin Diver, Aug. 1983, p. 51, Tabata Fin Ad.

*Primary Examiner*—Joseph F. Peters, Jr.
*Assistant Examiner*—Stephen P. Avila
*Attorney, Agent, or Firm*—Leonard Tachner; Fred Flam

[57] ABSTRACT

A hydrodynamic swim fin utilizes a wing and a tail that are overlapped normally to provide a two stage propulsion system. Ribs support the wing and tail and define flow channels. These ribs are parallel to each other and to the longitudinal axis of the fin whereby the effective area through which flow proceeds is uniform throughout the length of the fin. No parts of the ribs form barriers to the leading edges of the side wing segments whereby laminar flow is achieved. The fin part is maintained essentially rigid; however, the fin part is allowed limited angular movement about a defined transverse axis to achieve proper attack angle. Since the fin part is rigid, it maintains that attack angle throughout the length of the fin part. Trailing ends of the wing are individually flexible to produce greater opening for two stage propulsion during the power downstroke, and to produce substantial closure for one stage propulsion during the upstroke.

14 Claims, 5 Drawing Sheets

HYDRODYNAMIC SWIM FIN

FIELD OF INVENTION

This invention relates to an improvement in swim fins of the type shown in U.S. Pat. No. 3,183,529 to Georges Beuchat issued May 18, 1965, and widely marketed in the United States as the JETFIN® by the Scubapro Division of Under Sea Industries, Inc. of Rancho Dominguez, Calif.

BACKGROUND OF THE INVENTION

In the period of about 1940 to 1950, snorklers and spear fishermen began to use swim fins that were nothing more than paddle-like extensions of the feet of the user, providing more area for presentation to the water surface. Thus, a more efficient coupling was established between the swimmer's musculoskeletal structure and the water. Propulsion, speed and maneuverability were enhanced. See, for example, U.S. Pat. No. Re. 23,006 to Churchill, of June 15, 1948. In the early 1950s, Giovanni Cressi and Luigi Ferraro of Genoa, Italy recognized that efficient coupling depended on factors in addition to mere extension of foot area by the use of a fin. U.S. Pat. No. 2,727,668 to Cressi and Ferraro thus taught the use of a fin angled downwardly relative to the longitudinal axis of the foot. This angularity took into consideration the posture and leg movements of the human body while swimming and the direction of intended movement. To accommodate the angularity, a toe hole was provided.

In the early 1960s, Georges Beuchat of Marseille, France improved upon the Cressi-Ferraro fin structure by providing a two stage machine by the aid of vents in the medial portion of the fin part. The efficiency was improved by reducing drag, particularly during the power downstroke. The Beuchat JETFIN has been widely copied in recent years. Minor improvements have been suggested, such as equalizing the specific gravity of the fin, controlling the stiffness to achieve proper angularity of attack. The general objective has always been an increase in swimming efficiency and a corresponding decrease in fatigue.

The JETFIN, although it is a vastly improved machine as compared with the early single stage fins, nevertheless has certain imperfections. Some of these imperfections are believed to result from the fact that designers have considered only simple static force diagrams and angularity of musculoskeletal structures. In fact, a swim fin is a dynamic structure that moves through the water. One object of the present invention is to provide a swim fin so designed that the water flow is essentially laminar and free of excess turbulence.

Another imperfection is believed to result from the fact that the prior art fins assume different curvatures according to the direction of movement and the magnitude of the forces applied. As mentioned above, the control of proper curvature has been attempted by changing the composition of the material. In fact, it is angularity, not curvature that should be controlled, and angularity can be controlled by structural characteristics of bending, not merely by characteristics of materials. Another object of the present invention is to provide a swim fin in which angularity of the swim fin is accurately controlled both for the upstroke and for the downstroke whereby the ratio of power to fin area is markedly increased, which makes it possible to reduce the overall size of the swim fin without sacrificing total power.

It has been recognized that the swimmer has far less muscular power for the upstroke than for the downstroke. Since there is less power available, the machine operates better as a single stage propulsion device that as a two stage propulsion device. During this stroke, vents impede efficiency. Hence they are desirably closed during the upstroke. The prior art devices have achieved some measure of closing by virtue of a change in curvature. Another object of this invention is to provide a more effective closure for the upstroke.

SUMMARY OF INVENTION

The foregoing objects are provided by the following means. First, the outwardly flaring lateral ribs of prior art fins are eliminated. Instead, the outboard and inboard ribs are substantially parallel to the longitudinal axis of the swim fin; they neither flare outwardly towards the trailing (rear or aft) end of the fin nor curve inwardly toward the foot pocket part at their other ends. A foil or wing projects rearwardly of the foot pocket part, and has lateral segments on opposite sides stabilized by outboard ribs. Leading edges of the lateral wing segments smoothly divide the onflowing water to the surfaces of the fin. Since all of the ribs are parallel, the water flows along channels of uniform flow area; the parallel rib configuration makes it unnecessary for water to traverse the ribs. Secondly, the fin part is relatively stiff as compared with prior art swim fins. The fin part is nevertheless angularly movable about a transverse axis located near the toe region. Angular movement is provided by a unique design of slots in the ribs whereby flexibility is increased (or the bending moment of inertia reduced) at the toe region. The range of angular movement both for the upstroke and the downstroke is controlled. Since the stiff fin part maintains its configuration, the angle that it presents to the water is substantially uniform along its length. It neither curls nor uncurls. All areas of the fin part are optimally addressed for efficient power transfer.

Thirdly, flexible flaps open the flow channels during the downstroke for two stage propulsion, but close the flow channels almost completely during the upstroke to achieve single stage propulsion.

This invention possesses many other advantages, and has other objects which may be made more clearly apparent from a consideration of the embodiment of the invention shown and described.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention, the scope of the invention being defined by the appended claims.

Figure 1:
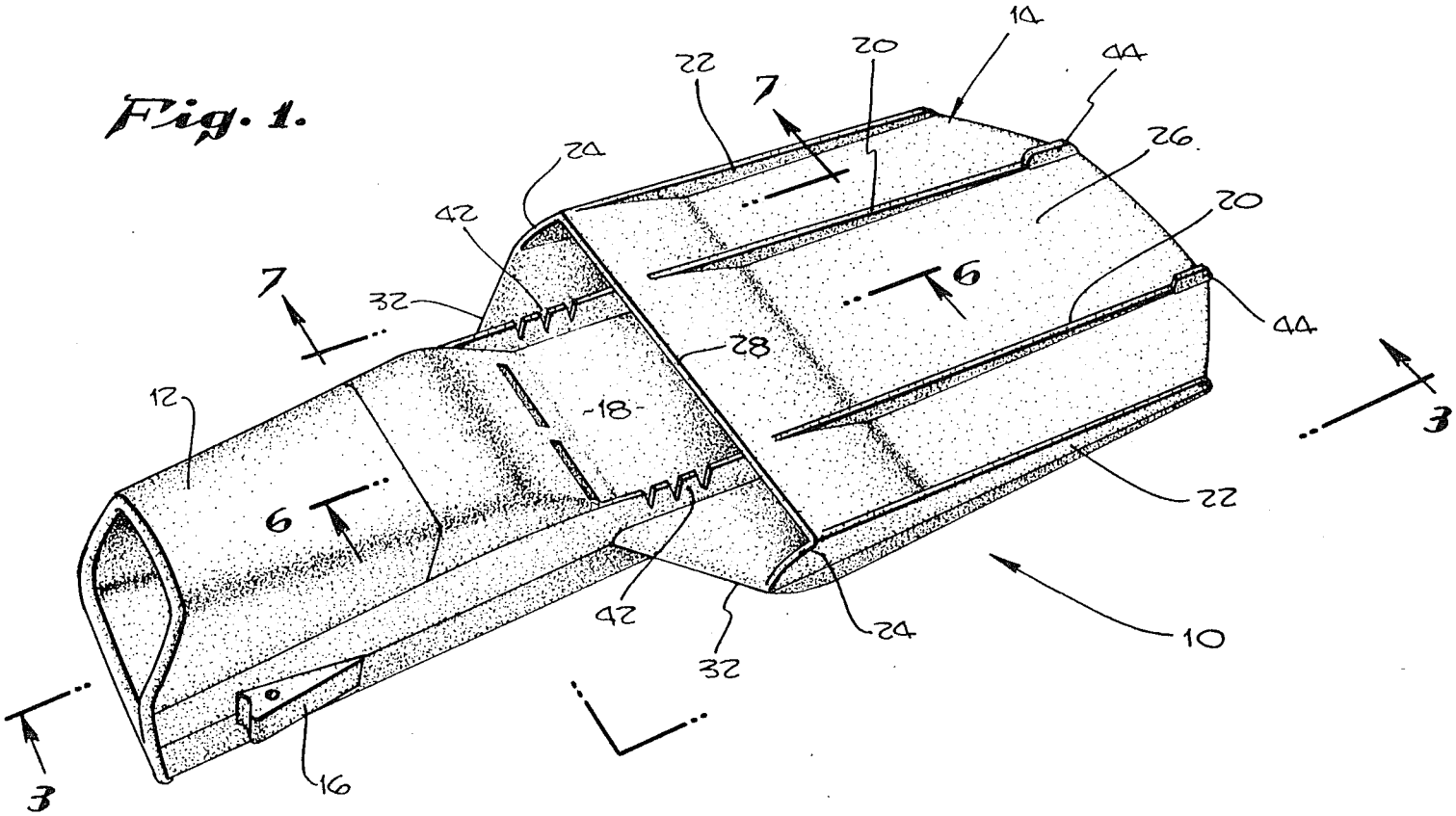
FIGS. 1 and 2 are companion top and bottom perspective views of a swim fin incorporating the present invention.
Figure 2:
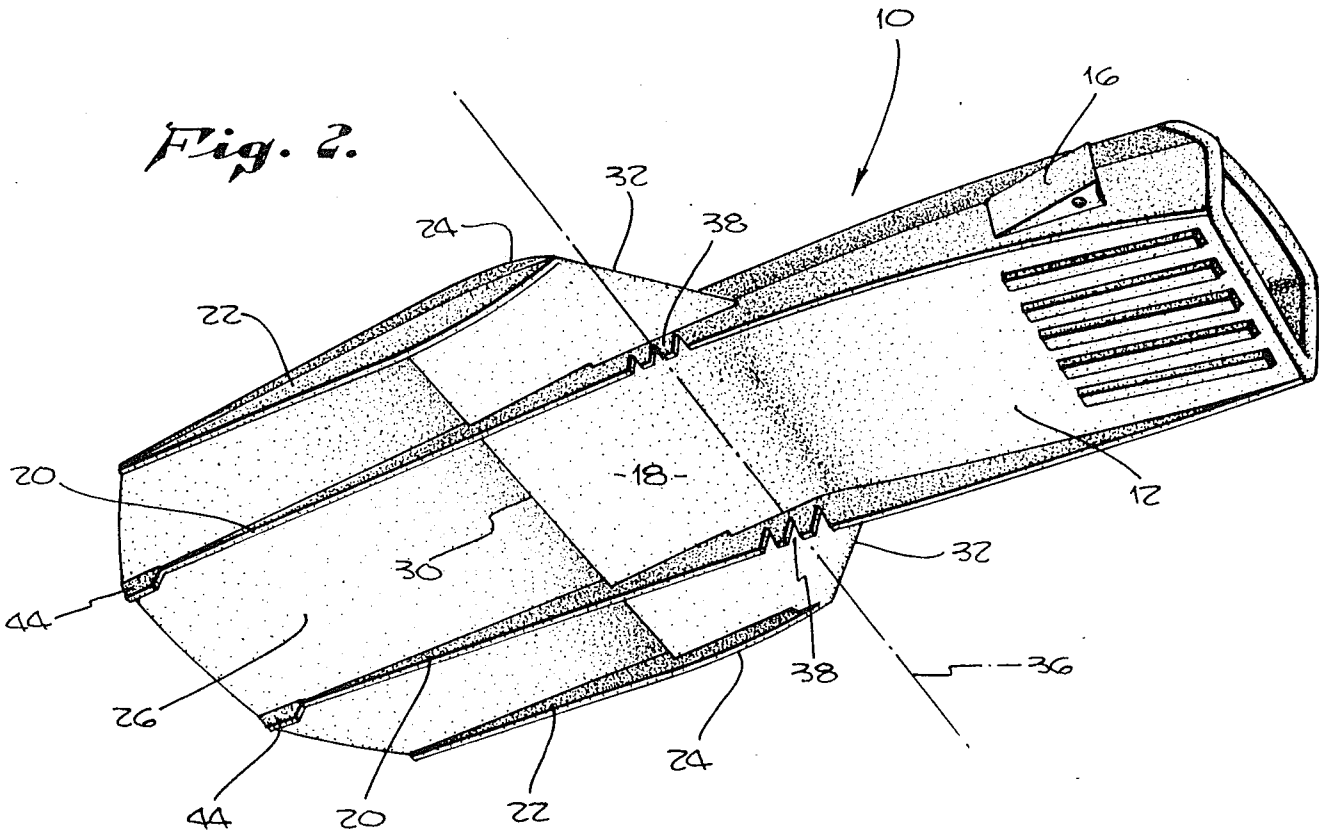
Figure 3:
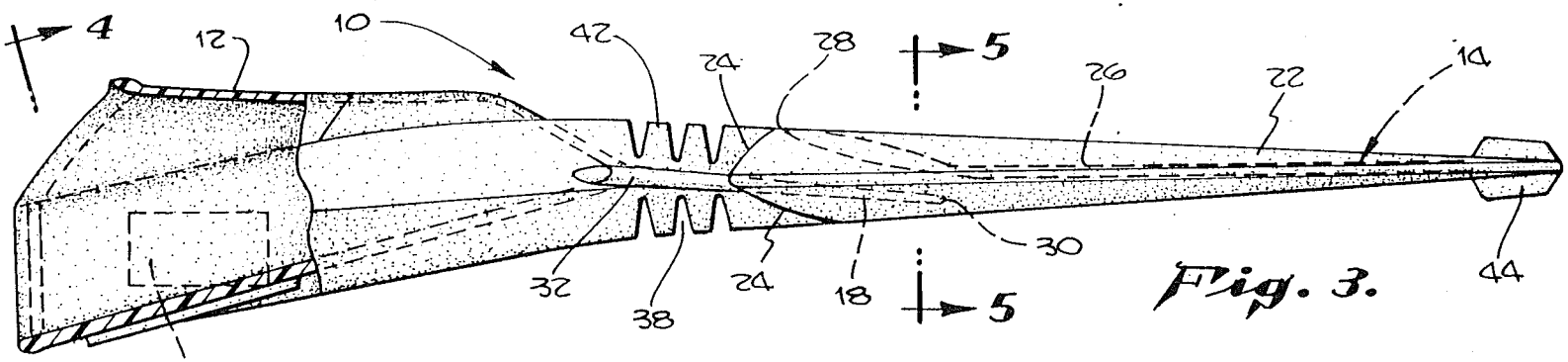
FIG. 3 is a side elevational view of the swim fin, the foot pocket part being shown in section along the plane indicated by line 3—3 of FIG. 1.
Figure 5:
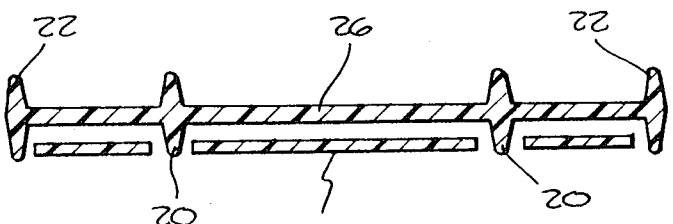
FIG. 5 is a transverse sectional view taken along a plane indicated by line 5—5 of FIG. 3.
Figure 4:
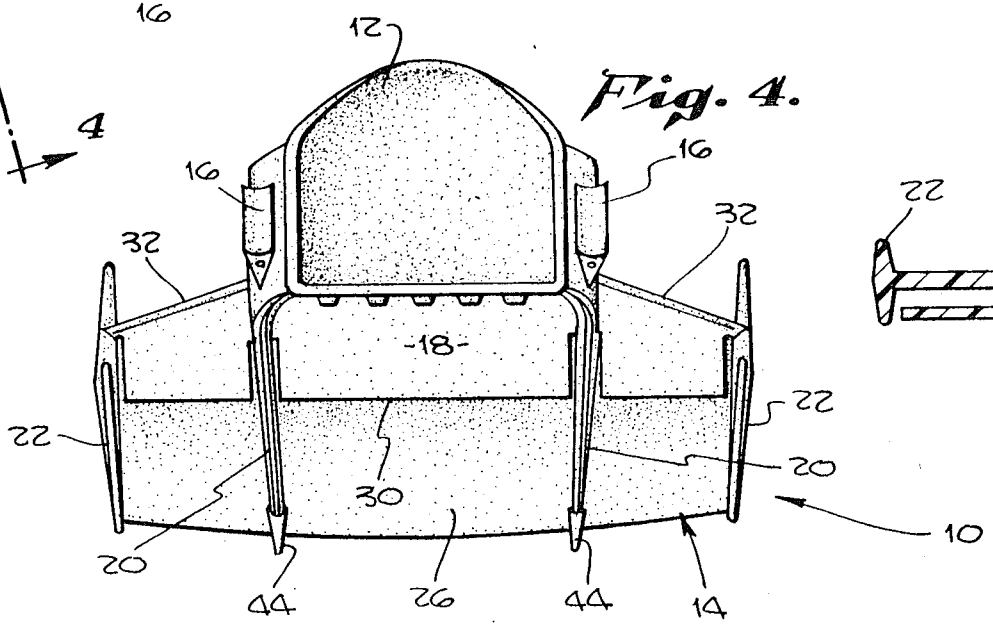
FIG. 4 is an elevational view taken in the directions along the axis of the foot pocket part as indicated by line 4—4 of FIG. 3.
Figure 6:
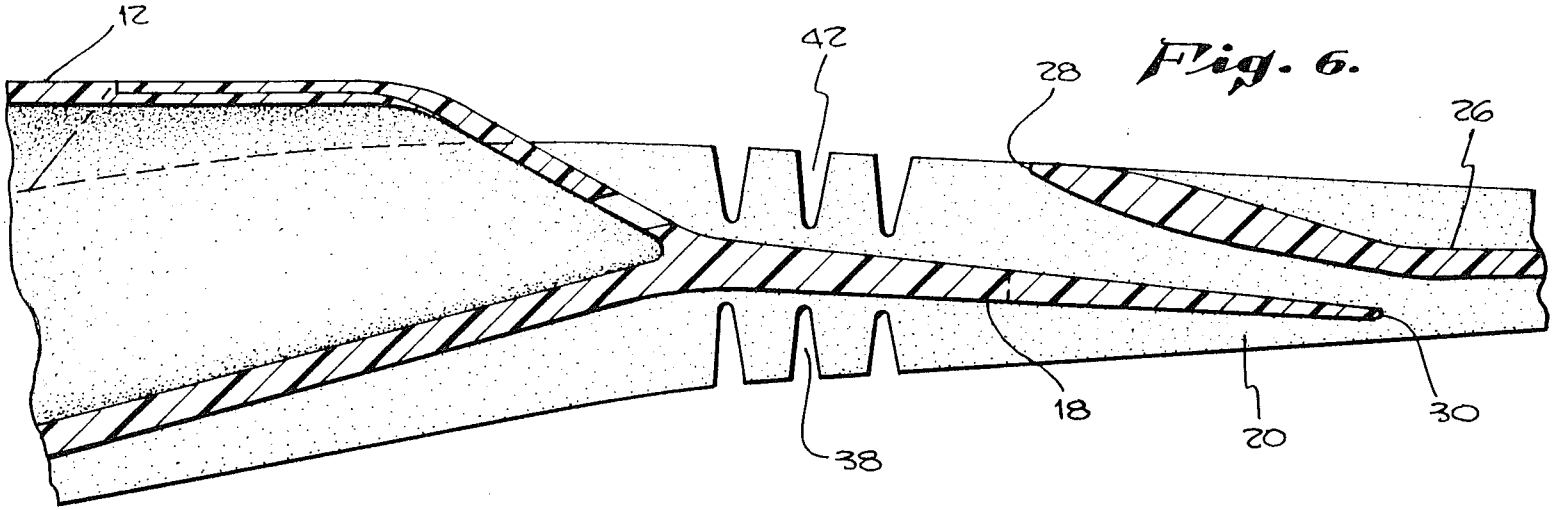
FIGS. 6 and 7 are enlarged fragmentary sectional views taken along planes indicated by lines 6—6 and 7—7 of FIG. 1.
Figure 7:
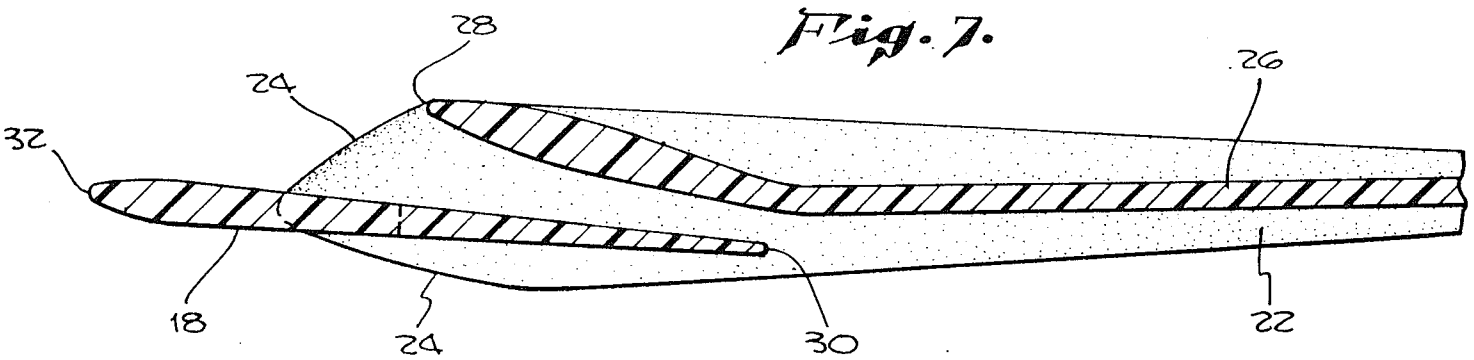

Shown in FIGS. 1 and 2 is a swim fin 10 that comprises a foot pocket part 12 and a fin part 14 fused together to form an integral structure. These parts may be molded of resilient plastic material such as medium density polyethylene. In the present instance the pocket part 12 has an open heel and lugs 16 for attachment of conventional heel straps (not shown). A closed heel could be provided instead.

The fin part 14 is a composite ribbed framework comprising a plurality (two in this instance) of staggered hydrofoil sections and a plurality (four in this instance) of longitudinally extending ribs.

One of the hydrofoil sections is a short wing 18 that projects beyond of the toe region of the pocket part 12. The wing 18 has a spread considerably wider than the transverse dimension of the foot pocket part 12.

Of the four ribs, two are inboard ribs 20 (FIG. 2) and two are outboard ribs 22. All of the ribs 20,22 are substantially parallel to each other and are parallel to the longitudinal axis of the fin. The inboard ribs 20 extend along the sides of the pocket part 12 and thence rearwardly (see also FIG. 1) to the fin end, the rearward portions of the ribs being tapered and, to a slight degree, downwardly angled. The inboard ribs 20 project slightly beneath the foot pocket part 12 to define a flow channel.

The inboard ribs 20 divide the wing 18 into a central or main segment and two projecting lateral segments.

The outboard ribs 22 extend along the outer sides of the lateral wing segments and do not directly join to the foot pocket part 12. The leading or frontal edges of the outboard ribs 22 are curved, as at 24, to reduce flow resistance.

The three wing segments extend generally along the midlines of the ribs, and terminate well short of the rib ends. This midline positioning of the wing segments causes flow channels to be defined along the top and bottom wing surfaces, the flow channel at the bottom of the main wing segment being a continuation of the flow channel at the bottom of the foot pocket part 12.

The second foil section is a tail 26 that overlies the wing (FIG. 1). The tail has a leading edge 28 located above the top surface of the wing 18, and approximately at the midlength position of the flow channels formed on the wing top. The edge 28 coincides with the top edges of the ribs 20, 22. As the tail extends rearwardly from its leading edge 28 at the top edges of the ribs 20, 22, it drops generally to the midlines of the ribs and then continues to the fin end, well beyond the trailing edge 30 of the wing 18.

The wing, tail and ribs cooperate to define a fairly rigid cage or framework.

The flow channels on the top of the wing 18 are initially unbounded at the top for entry of water thereto. The overlying tail 26 then completes the peripheral boundary of these channels, which downstream open downwardly beyond the trailing wing edge 30. Two stage propulsion is provided.

All of the surfaces of the wing and tail are carefully contoured to minimize turbulence.

As the swimmer propels himself, water passes along the sides, top and bottom of the pocket part 12. The toe portion of the pocket part 12 is closed except for narrow vent slits, and contoured in order to provide a smooth flow path to the main segment of the wing 18. The parallel disposition of the ribs provides a flow channel configuration that is uniform along the length of the swim fin. The flowing water need never traverse ribs interposed in its path. Resistance to flow is minimized, and the swimmer's energy is not dissipated in creating turbulence.

The lateral segments of the wing have leading edges 32 that slant rearwardly, smoothly dividing the onflowing water. The outboard ribs 22 do not interfere.

Figure 9:
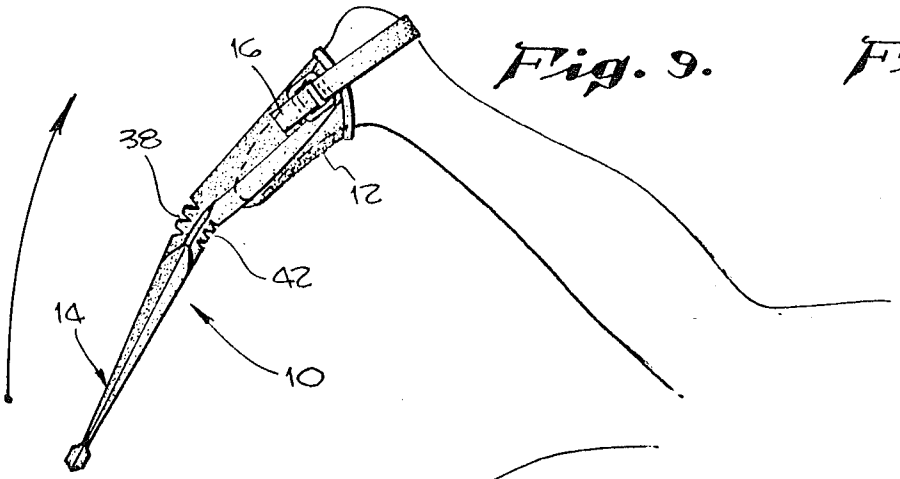
FIGS. 8 and 9 are companion diagrammatic views illustrating the fin in place upon the foot of the swimmer, FIG. 8 illustrating the power downstroke, and FIG. 9 illustrating the upstroke.
Figure 8:
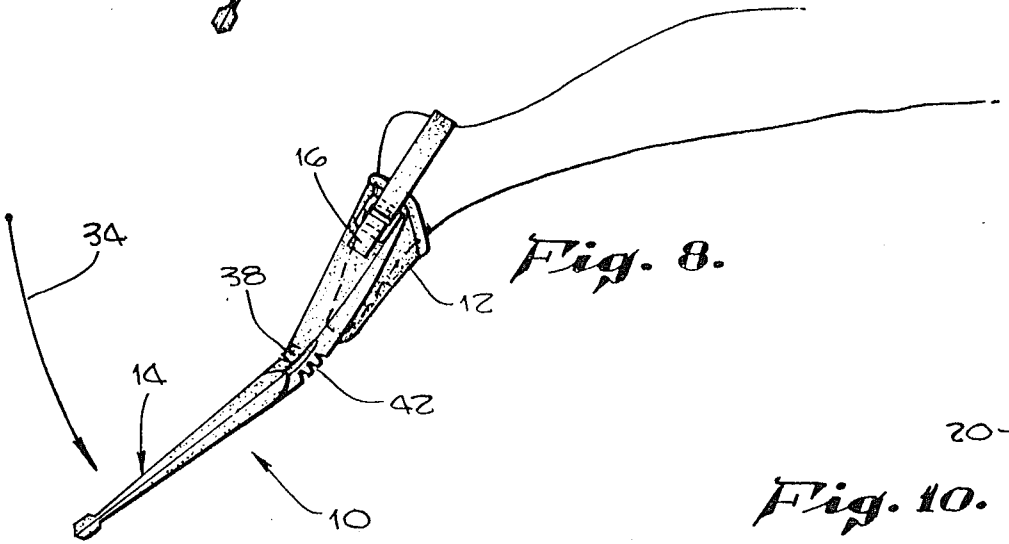

FIGS. 8 and 9 illustrate the fin in use during the power downstroke (FIG. 8) and the upstroke (FIG. 9). In FIG. 8, the foot is moving generally in the direction of the arrow 34; the reaction of the water tends to move the fin part angularly in the direction opposite the arrow or the swimmer's foot. Such angular movement is in fact permitted. For this purpose, a transverse pivot axis 36 (FIG. 2) is defined by a series of V-shaped notches 38 that extend inwardly from the lower edges of the inboard ribs 20. This axis is forward of the outboard ribs 22; hence only the inboard ribs 20 need be notched to provide the region of reduced bending moment of inertia. Desirably, the notches substantially close during the power downstroke as shown in FIG. 8. Closing depends upon the kick force exceeding a certain designed minimum value.

Since the fin part is relatively rigid, flexure is confined to the region at the axis 36 and the fin part 14 remains essentially flat. The attack angle is optimized along the entire length of the fin part 14, and not merely at one location, as would be the case if the fin part 14 were allowed to flex. The increased efficiency derived from the use of a rigid fin and from the use of flow channels of uniform area permits the design of a powerful fin having a relatively short fin part.

The fin part 14 desirably assumes a different angular position during the upstroke, illustrated in FIG. 9 in which it moves angularly in an upward direction relative to the foot. The reaction of the water tends to cause such angular movement. Such movement is permitted. For this purpose, a series of V-shaped notches or slots 42 are provided at the top edges of the ribs 20, which are opposite the slots or notches 38. The angular upstroke movement for maximum efficiency may be the same as, or different from, the angular movement for the downstroke.

Figure 11:
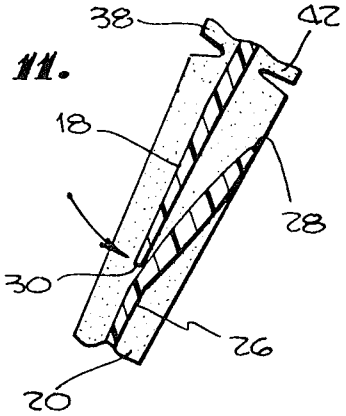
FIGS. 10 and 11 are enlarged fragmentary longitudinal sectional views similar to FIGS. 6 and 7, but showing the position of the vent closures during the downstroke and upstroke respectively.
Figure 10:
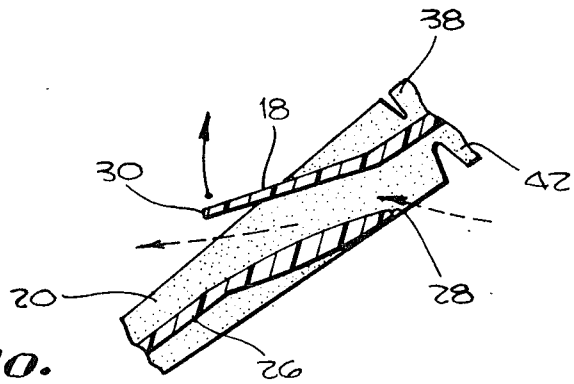

The flow channels between the overlapping hydrofoil sections open during the downstroke (FIG. 10) to ensure the flow transfer or venting necessary for two stage operation, and close during the upstroke. To achieve this alternate operation, the trailing ends of the segments of the wing 18 are each laterally relieved to be free of the ribs. This allows the trailing ends of the segments to flex away from the overlying tail to open the channels during the downstroke (FIG. 10) and to flex toward the overlying tail to close the channels during the upstroke (FIG. 11).

To achieve increased lateral stability at the trailing edge of the fin, strakes 44 are provided at the ends of the ribs 20.

The word "rearwardly" as used in the claims relates to the direction of movement of the swimmer in the water, the heel portion being forward, and the fin tip being rearward. Intending to claim all novel, useful and unobvious features and combinations of features shown and/or described,

We claim:

1. A fin for swimmers having a foot pocket part and a fin part, characterized by:

(a) a pair of inboard ribs extending along and rearwardly of the sides of said foot pocket part, said ribs terminating adjacent the end of said fin part;

(b) a wing extending rearwardly of said foot pocket part and having a segment extending between said inboard ribs and having lateral segments extending from said inboard ribs;

(c) a pair of outboard ribs attached to the outer edges of said lateral wing segments said outboard ribs extending rearwardly and terminating adjacent the end of said fin part;

(d) a tail having a main segment extending between said inboard ribs and having lateral segments between said inboard ribs and said outboard ribs respectively, said tail being located in spaced juxtaposed relationship to said wing to form therewith peripherally bounded flow channels leading from the top of said wing to the bottom of said tail;

(e) said wing terminating at a trailing edge located intermediate the length of said tail, and said tail having a leading edge located intermediate the length of said wing to provide a two stage propulsion device;

(f) said ribs extending parallel to each other and to the length of said fin so that the effective areas of said flow channels are substantially uniform throughout the length of said fin;

(g) said lateral wing segments having leading edges unobstructed by said ribs for substantially laminar flow of water to the surfaces of said lateral side wing segments.

2. The swim fin as set forth in claim 1 in which said fin part is relatively rigid whereby said fin part maintains its shape under stress; means defining a transverse axis of movement of said fin part relative to said foot pocket part for angular movement thereof by the reaction of water; and means limiting the angular movement of said fin part.

3. The swim fin as set forth in claim 1 in which said wing segments have flexible parts movable to increase the opening of said flow channels during downstroke and to close said flow channels during upstroke whereby a two stage propulsion system is provided for the downstroke and a one stage propulsion system is provided for the upstroke.

4. A fin for swimmers characterized by:

a. a foot pocket part;

b. a fin part projecting rearwardly from said foot pocket part;

c. said fin part being relatively rigid sufficient to maintain its essential shape under stress;

d. means defining a transverse axis of movement of said fin part relative to said foot pocket part for angular movement thereof by the reaction of water imposed upon said fin;

e. said axis being located rearwardly of the toe region of said foot pocket part;

f. means limiting the angular movement of said fin part in opposite directions;

g. a wing projecting rearwardly of said foot pocket part, and a tail partially overlapping said wing, and extending beyond said wing to form therewith a two stage propulsion device; and h. a plurality of ribs extending parallel to each other and parallel to the longitudinal axis of said foot pocket part to impart rigidity to said fin, said wing having segments extending laterally on opposite sides of said foot pocket part with leading edges free of ribs and in the path of onflowing water.

5. The swim fin as set forth in claim 4 in which said wing has a flexible part operative upon the upstroke of said swim fin to close communication between said propulsion stages.

6. The swim fin as set forth in claim 4 in which said defining means comprises V-shaped notches in said ribs, and said limiting means comprises the side walls of said notches.

7. In a swim fin having a foot pocket part and a fin part, said fin part including a wing extending rearwardly of said foot pocket part and a terminal tail overlying said wing and longitudinally offset therefrom and projecting therebeyond, said wing and tail together forming a channel for flow of water from the upper side of said wing to the lower side of said tail, said fin having a plurality of ribs extending longitudinally of said fin for reinforcing said fin part, characterized by:

a. said wing having side segments extending laterally of said foot pocket part;

b. two of said ribs defining the operative lateral boundaries of said fin part and joined to said side segments of said wing;

c. said side segments of said wing having leading edges exposed to the onflowing water and operative to divide said onflowing water as it traverses said wing segments;

d. all of said ribs extending substantially parallel to each other and parallel to the longitudinal axis of said fin whereby the effective area for water flow along said fin part is essentially uniform.

8. The swim fin as set forth in claim 7 together with means defining an axis of angular movement between said fin part and said foot pocket part; and means limiting angular movement of said fin part relative to said foot pocket part; said fin part being substantially rigid whereby its angular address to the water remains substantially constant along its length.

9. The swim fin as set forth in claim 7 together with means operative only upon upstroke movement of said fin for substantially closing said flow channel.

10. A fin for swimmers having a foot pocket part and a fin part, characterized by:

(a) a wing extending rearwardly of said foot pocket part, said wing having segments projecting laterally of said foot pocket;

(b) a relatively rigid tail joined to said wing;

(c) means forming a flow channel leading from the top of said wing to the bottom of said tail to provide a two stage propulsion device;

(d) the effective area of said flow channel being substantially uniform along the length of said fin;

(e) said lateral wing segments having unobstructed leading edges for substantially laminar flow of water to the surfaces of said lateral side wing segments.

11. The fin as set forth in claim 10 together with means defining a transverse axis of movement of said fin part relative to said foot pocket part for angular movement thereof by reaction of water; and means limiting the angular movement in opposite directions.

12. In a swim fin having a foot pocket part and a fin part, said fin part including a wing extending rearwardly of said foot pocket part and a terminal tail overlying said wing and longitudinally offset therefrom and projecting longitudinally therebeyond, said wing and said tail together forming a channel for flow of water from the upper side of said wing to the lower side of said tail, said fin having a plurality of ribs extending longitudinally of said fin for reinforcing said fin part, characterized by:

a. said foot pocket part having a substantially closed toe portion merging into a central segment of said wing that extends between a first two of said ribs, said first two of said ribs extending rearwardly from the sides of said foot pocket part;

b. said wing having side segments extending laterally of said foot pocket part and laterally of said central segment;

c. another two of said ribs defining the operative lateral boundaries of said fin part and joined to said side segments of said wing;

d. said ribs extending substantially parallel to each other and to the longitudinal axis of said fin whereby water flowing along said fin need not move laterally of said fin;

e. said first two ribs having one or more V-shaped notches or regions of reduced bending moment of inertia at its top and bottom edges to define an axis of limited angular movement of said fin part relative to said foot pocket part;

f. said fin part being substantially rigid so that it maintains its essential configuration independent of angular orientation of said fin part relative to said foot pocket part.

13. The swim fin as set forth in claim 12 in which said side segments of said wing have leading edges exposed to the oncoming water to divide said water for smooth flow to the surfaces of said fin part.

14. The swim fin as set forth in claim 13 in which said wing segments have trailing portions capable of flexing to close said channel upon upstroke movement of said swim fin, and further to open said channel upon downstroke movement of said swim fin.

* * * * *